US011946153B2

(12) United States Patent
Hatabe et al.

(10) Patent No.: US 11,946,153 B2
(45) Date of Patent: Apr. 2, 2024

(54) COPPER OR COPPER ALLOY ELECTROPLATING BATH

(71) Applicant: ISHIHARA CHEMICAL CO., LTD., Kobe (JP)

(72) Inventors: Masaru Hatabe, Kobe (JP); Hironori Murakami, Kobe (JP); Fuka Yamaoka, Kobe (JP)

(73) Assignee: ISHIHARA CHEMICAL CO., LTD., Kobe (JP)

( * ) Notice: Subject to any disclaimer, the term of this patent is extended or adjusted under 35 U.S.C. 154(b) by 0 days.

(21) Appl. No.: 17/427,515

(22) PCT Filed: Jan. 16, 2020

(86) PCT No.: PCT/JP2020/001294
§ 371 (c)(1),
(2) Date: Jul. 30, 2021

(87) PCT Pub. No.: WO2020/158418
PCT Pub. Date: Aug. 6, 2020

(65) Prior Publication Data

US 2022/0127741 A1 Apr. 28, 2022

(30) Foreign Application Priority Data

Feb. 1, 2019 (JP) ..... 2019-017033
Jan. 10, 2020 (JP) ..... 2020-002514

(51) Int. Cl.
*C25D 3/38* (2006.01)
*C25D 3/58* (2006.01)
*C25D 7/12* (2006.01)

(52) U.S. Cl.
CPC ..... *C25D 3/38* (2013.01); *C25D 3/58* (2013.01); *C25D 7/12* (2013.01)

(58) Field of Classification Search
None
See application file for complete search history.

(56) References Cited

U.S. PATENT DOCUMENTS

| | | | | |
|---|---|---|---|---|
| 3,520,784 | A | 7/1970 | Alberts et al. | |
| 6,709,564 | B1 | 3/2004 | Tench | |
| 2002/0043467 | A1 | 4/2002 | Morrissey | |
| 2007/0012576 | A1* | 1/2007 | Binstead | C25D 5/611 205/291 |
| 2007/0205109 | A1 | 9/2007 | Watanabe et al. | |
| 2013/0264214 | A1 | 10/2013 | Hamm | |
| 2017/0037528 | A1 | 2/2017 | Thorseth | |
| 2017/0283970 | A1 | 10/2017 | Thorseth | |
| 2017/0370014 | A1 | 12/2017 | Pokhrel | |

FOREIGN PATENT DOCUMENTS

| | | | |
|---|---|---|---|
| JP | 9-202990 | A | 8/1997 |
| JP | 2002-302789 | A | 10/2002 |
| JP | 2003-533867 | A | 11/2003 |
| JP | 2013-229596 | A | 11/2013 |
| JP | 2017-036502 | A | 2/2017 |
| JP | 2017-222925 | A | 12/2017 |
| JP | 2018-012885 | A | 1/2018 |

OTHER PUBLICATIONS

Metallov, Throwing power of copper plating sulfate electrolyte containing nitrate ion, vol. 24, No. 2, pp. 305-307, 1988.
International Search Report dated Apr. 7, 2020 in International Application No. PCT/JP2020/001294.
Office Action dated May 23, 2023 in Taiwanese Patent Application No. 109101982.
Office Action received in Japanese Application No. JP2020-002514 dated Jan. 9, 2024, 2023 in 12 pages.

* cited by examiner

*Primary Examiner* — Wojciech Haske
(74) *Attorney, Agent, or Firm* — Knobbe, Martens, Olson & Bear LLP

(57) ABSTRACT

A copper or copper alloy electroplating bath has two or more electrolytes. The two or more electrolytes include at least one selected from nitric acid and a nitrate. The two or more electrolytes can form electrodeposits, such as a group of high-aspect bump electrodes, that have a uniform height or thickness at high speed.

13 Claims, No Drawings

COPPER OR COPPER ALLOY ELECTROPLATING BATH

PRIORITY AND CROSS REFERENCE TO RELATED APPLICATIONS

This application is the U.S. National Stage Application under 35 U.S.C. § 371 of International Application No. PCT/JP2020/001294, filed Jan. 16, 2020, designating the U.S. and published as WO 2020/158418 A1 on Aug. 6, 2020, which claims the benefit of Japanese Application No. JP 2019-017033, filed Feb. 1, 2019, and Japanese Application No. JP 2020-002514, filed Jan. 10, 2020. Any and all applications for which a foreign or a domestic priority is claimed is/are identified in the Application Data Sheet filed herewith and is/are hereby incorporated by reference in their entirety under 37 C.F.R. § 1.57.

TECHNICAL FIELD

The present invention relates to a copper or copper alloy electroplating bath. More specifically, the present invention relates to a copper or copper alloy electroplating bath which can form electrodeposits, such as a group of high-aspect bump electrodes, having a uniform height or thickness at high speed with a significantly reduced occurrence frequency of abnormal precipitation.

BACKGROUND ART

In the case of performing electroplating on an electronic component to form electrodeposits such as bump electrodes (copper pillars) or electrodeposition coatings, a Package on Package (PoP) semiconductor component and the like having a three-dimensional structure with a reduced package area is produced to reduce the size and the space of, for example, a semiconductor chip.

For a three-dimensional configuration of a semiconductor chip, a chip at an upper location has to be bonded to wires at a lower location, and in this case, for example, a method of forming and bonding high-aspect bump electrodes is preferably adopted.

As electroplating baths for forming such bump electrodes, plating baths as disclosed in, for example, Patent Literatures 1 to 3 have been proposed.

In the case of bonding chip components such as LSIs and ICs, securing uniformity in shape, particularly in height, of the bump electrodes is important to reliably achieve the bonding. This also applies to inter-substrate bonding for bonding substrates via bump electrodes.

Conventional general electrolytes, for example, sulfuric acid and methanesulfonic acid, are limited in solubility or cannot maintain high-speed performance due to their characteristics. Thus, as disclosed in, for example, Patent Literatures 1 to 3, a prescribed organic acid in addition to methanesulfonic acid or a specific organic compound as an additive is included in a plating bath including these electrolytes in an attempt to improve characteristics of the plating bath.

However, it is very difficult for a conventional plating bath as described above to form high-aspect electrodeposits having a uniform height at high speed on an electronic component, in particular, such as a PoP semiconductor component having a three-dimensional structure with a reduced package area.

CITATION LIST

Patent Literature

[Patent Literature 1] Japanese Laid-Open Patent Publication No. 2002-302789

[Patent Literature 2] Japanese Laid-Open Patent Publication No. 2017-222925

[Patent Literature 3] Japanese Laid-Open Patent Publication No. 2018-012885

SUMMARY OF INVENTION

An object of the present invention is to provide a copper or copper alloy electroplating bath which can form electrodeposits, such as a group of high-aspect bump electrodes, having a uniform height or thickness at high speed.

A present invention 1 relates to a copper or copper alloy electroplating bath comprising two or more electrolytes, wherein the electrolytes include at least one selected from nitric acid and a nitrate.

In a present invention 2 referring to the present invention 1, the copper or copper alloy electroplating bath is to be applied to formation of a copper pillar or a copper alloy pillar having a height of 5 μm or more.

In a present invention 3 referring to the present invention 2, the copper pillar or the copper alloy pillar is to be formed on a System in Package (SiP), Fan Out Wafer Level Package (FOWLP), Fan Out Panel Level Package (FOPLP), System on a Chip (SoC), or Package on Package (PoP) electronic component.

In a present invention 4 referring to the present invention 1, the nitrate is at least one selected from the group consisting of sodium nitrate, potassium nitrate, magnesium nitrate, calcium nitrate, barium nitrate, zinc nitrate, silver nitrate, copper(II) nitrate, nickel nitrate, aluminum nitrate, iron(III) nitrate, and ammonium nitrate.

In a present invention 5 referring to the present invention 1, a content of the electrolytes is in the range from 1 g/L to 500 g/L.

In a present invention 6 referring to the present invention 1, the electrolytes further include at least one selected from an acid other than nitric acid, a chloride, a sulfate, a carbonate, a phosphate, an acetate, and a perchlorate.

In a present invention 7 referring to the present invention 6, the acid other than nitric acid is at least one selected from the group consisting of hydrochloric acid, sulfuric acid, methanesulfonic acid, acetic acid, carbonic acid, phosphoric acid, boric acid, oxalic acid, lactic acid, hydrogen sulfide, hydrofluoric acid, formic acid, perchloric acid, chloric acid, chlorous acid, hypochlorous acid, hydrobromic acid, hydriodic acid, nitrous acid, and sulfurous acid.

In a present invention 8 referring to the present invention 6, the chloride is at least one selected from the group consisting of lithium chloride, sodium chloride, potassium chloride, magnesium chloride, calcium chloride, barium chloride, zinc chloride, copper(II) chloride, aluminum chloride, iron(III) chloride, and ammonium chloride.

In a present invention 9 referring to the present invention 6, the carbonate is at least one selected from the group consisting of sodium carbonate, sodium hydrogen carbonate, potassium carbonate, potassium hydrogen carbonate, copper(II) carbonate, and ammonium carbonate.

In a present invention 10 referring to the present invention 6, the phosphate is at least one selected from the group consisting of sodium phosphate, disodium hydrogen phosphate, sodium hydrogen phosphate, potassium phosphate, dipotassium hydrogen phosphate, and potassium hydrogen phosphate.

In a present Invention 11 referring to the present invention 6, the acetate is at least one selected from the group consisting of sodium acetate, potassium acetate, calcium acetate, copper(II) acetate, aluminum acetate, and ammonium acetate.

In a present Invention 12 referring to the present invention 6, the perchlorate is at least one selected from sodium perchlorate and potassium perchlorate.

Adopting the copper or copper alloy electroplating bath of the present invention enables electrodeposits, such as a group of high-aspect bump electrodes, having a uniform height or thickness to be formed at high speed with a significantly reduced occurrence frequency of abnormal precipitation, and enables productivity of electronic components to be improved.

DETAILED DESCRIPTION

The copper or copper alloy electroplating bath of the present invention comprises two or more electrolytes, and the electrolytes include at least one selected from nitric acid and a nitrate.

The nitrate is preferably, for example, at least one selected from the group consisting of sodium nitrate, potassium nitrate, magnesium nitrate, calcium nitrate, barium nitrate, zinc nitrate, silver nitrate, copper(II) nitrate, nickel nitrate, aluminum nitrate, iron(III) nitrate, and ammonium nitrate. Among them, silver nitrate and copper(II) nitrate are preferable because of their easy handleability and significant effects for improving high-speed plating and uniformity in height or thickness of the electrodeposits. Note that among these nitrates, copper(II) nitrate acts also as a copper ion-supplying compound described later, and zinc nitrate and silver nitrate act also as soluble salts of metal producing an alloy together with copper, described later.

A combination of the two or more electrolytes is not particularly limited, and the electrolytes include at least one selected from nitric acid and the nitrate (hereinafter also referred to as "nitric acids"). All of the two or more electrolytes may be selected from nitric acid and the nitrate, and the two or more electrolytes may include at least one (hereinafter also referred to as "another electrolyte") selected from an acid other than nitric acid, a chloride, a sulfate, a carbonate, a phosphate, an acetate, and a perchlorate, in addition to the nitric acids. That is, examples of the combination of the two or more electrolytes may include: nitric acid and at least one of the nitrates; at least two of the nitrates; nitric acid and at least one of the another electrolytes; at least one of the nitrates and at least one of the another electrolytes; and nitric acid, at least one of the nitrates and at least one of the another electrolytes.

The acid other than nitric acid is preferably, for example, at least one selected from the group consisting of hydrochloric acid, sulfuric acid, methanesulfonic acid, acetic acid, carbonic acid, phosphoric acid, boric acid, oxalic acid, lactic acid, hydrogen sulfide, hydrofluoric acid, formic acid, perchloric acid, chloric acid, chlorous acid, hypochlorous acid, hydrobromic acid, hydriodic acid, nitrous acid, and sulfurous acid. Among them, sulfuric acid, methanesulfonic acid, and hydrochloric acid are preferable because of their satisfactory affinity with nitric acid and the nitrates. Note that hydrochloric acid acts also as a chloride ion-supplying source.

The chloride acts as the chloride ion-supplying source in a similar manner to hydrochloric acid. The chloride is preferably, for example, at least one selected from the group consisting of lithium chloride, sodium chloride, potassium chloride, magnesium chloride, calcium chloride, barium chloride, zinc chloride, copper(II) chloride, aluminum chloride, iron(III) chloride, and ammonium chloride.

The carbonate is preferably, for example, at least one selected from the group consisting of sodium carbonate, sodium hydrogen carbonate, potassium carbonate, potassium hydrogen carbonate, copper(II) carbonate, and ammonium carbonate.

The phosphate is preferably, for example, at least one selected from the group consisting of sodium phosphate, disodium hydrogen phosphate, sodium hydrogen phosphate, potassium phosphate, dipotassium hydrogen phosphate, and potassium hydrogen phosphate.

The acetate is preferably, for example, at least one selected from the group consisting of sodium acetate, potassium acetate, calcium acetate, copper(II) acetate, aluminum acetate, and ammonium acetate.

The perchlorate is preferably, for example, at least one selected from sodium perchlorate and potassium perchlorate.

In the copper or copper alloy electroplating bath of the present invention, a content of the electrolytes is preferably in the range from 1 g/L to 500 g/L, more preferably in the range from 5 g/L to 300 g/L. When the content of the electrolytes is less than the lower limit of the range, satisfactory effects for improving the high-speed plating and the uniformity in height or thickness of the electrodeposits may not be exhibited. When the content of the electrolytes is more than the upper limit of the range, compatibility with, for example, another components described later becomes to be low, and thus, it may be difficult to obtain a homogeneous plating bath.

When the nitric acids and at least one of the another electrolytes are used in combination, the ratio of the nitric acids to the another electrolyte (nitric acids/another electrolyte (weight ratio)) is preferably in the range from about 0.001/1 to about 1000/1, more preferably in the range from about 0.01/1 to about 100/1, particularly preferably in the range from about 0.1/1 to about 50/1 because effects of both the nitric acids and the another electrolyte can be exhibited in a balanced manner.

When nitric acid is used as the nitric acids in the combination of the nitric acids and the another electrolyte, that is, nitric acid and at least one of the another electrolytes are used in combination, the ratio of nitric acid to the another electrolyte (nitric acid/another electrolyte (weight ratio)) is preferably in the range from about 0.05/1 to about 30/1, more preferably in the range from about 0.08/1 to about 20/1 because effects of both nitric acid and the another electrolyte can be exhibited in a balanced manner.

When the nitrate is used as the nitric acids in the combination of the nitric acids and the another electrolyte, that is, at least one of the nitrates and at least one of the another electrolytes are used in combination, the ratio of the nitrate to the another electrolyte (nitrate/another electrolyte (weight ratio)) is preferably in the range from about 0.05/1 to about 20/1, more preferably in the range from about 0.05/1 to about 10/1 because effects of both the nitrate and the another electrolyte can be exhibited in a balanced manner.

When nitric acid and at least one of the nitrates are used in combination, the ratio of nitric acid to the nitrate (nitric acid/nitrate (weight ratio)) is preferably in the range from about 0.2/1 to about 10/1, more preferably in the range from about 0.5/1 to about 5/1 because effects of both nitric acid and the nitrate can be exhibited in a balanced manner. Note that when at least two of the nitrates are used in combination, the ratio is suitably adjusted in accordance with the kinds of the nitrates.

The copper or copper alloy electroplating bath of the present invention may include, for example, one or more copper ion-supplying compounds in addition to the two or more electrolytes.

The copper ion-supplying compound is not particularly limited and may be a copper soluble salt producing $Cu^{2+}$ basically in an aqueous solution. Examples of the copper ion-supplying compound include: a copper carboxylic acid salt such as copper acetate, copper oxalate, and copper citrate; a copper alkylsulfonic acid salt such as copper methanesulfonate and copper hydroxyethanesulfonate; and the like in addition to copper sulfate, copper oxide, copper nitrate, copper chloride, copper pyrophosphate, and copper carbonate. Among these compounds, one or more compounds may be used as the copper ion-supplying compound.

A content of the copper ion-supplying compound in the copper electroplating bath of the present invention is not particularly limited. The content is preferably in the range from about 1 g/L to about 300 g/L, more preferably in the range from about 30 g/L to about 250 g/L.

When the plating bath of the present invention is the copper electroplating bath, at least the copper ion-supplying compound is included, whereas when the plating bath of the present invention is the copper alloy electroplating bath, at least one or more soluble salts of metal producing an alloy together with copper are also included.

The metal producing an alloy together with copper is not particularly limited. Examples of the metal include silver, zinc, nickel, bismuth, cobalt, indium, antimony, tin, gold, and lead.

Examples of the soluble salt of silver include silver carbonate, silver nitrate, silver acetate, silver chloride, silver oxide, silver cyanide, potassium silver cyanide, silver methanesulfonate, silver 2-hydroxyethanesulfonate, and silver 2-hydroxypropanesulfonate.

Examples of the soluble salt of zinc include zinc oxide, zinc sulfate, zinc nitrate, zinc chloride, zinc pyrophosphate, zinc cyanide, zinc methanesulfonate, zinc 2-hydroxyethanesulfonate, and zinc 2-hydroxypropanesulfonate.

Examples of the soluble salt of nickel include nickel sulfate, nickel formate, nickel chloride, nickel sulfamate, nickel borofluoride, nickel acetate, nickel methanesulfonate, and nickel 2-hydroxypropanesulfonate.

Examples of the soluble salt of bismuth include bismuth sulfate, bismuth gluconate, bismuth nitrate, bismuth oxide, bismuth carbonate, bismuth chloride, bismuth methanesulfonate, and bismuth 2-hydroxypropanesulfonate.

Examples of the soluble salt of cobalt include cobalt sulfate, cobalt chloride, cobalt acetate, cobalt borofluoride, cobalt methanesulfonate, and cobalt 2-hydroxypropanesulfonate.

Examples of the soluble salt of indium include indium sulfamate, indium sulfate, indium borofluoride, indium oxide, indium methanesulfonate, and indium 2-hydroxypropanesulfonate.

Examples of the soluble salt of antimony include antimony borofluoride, antimony chloride, potassium antimonyl tartrate, potassium pyroantimonate, antimony tartrate, antimony methanesulfonate, and antimony 2-hydroxypropanesulfonate.

Examples of the soluble salt of tin include stannous sulfate, stannous acetate, stannous borofluoride, stannous sulfamate, stannous pyrophosphate, stannous chloride, stannous gluconate, stannous tartrate, stannous oxide, sodium stannate, potassium stannate, stannous methanesulfonate, stannous ethanesulfonate, stannous 2-hydroxyethanesulfonate, stannous 2-hydroxypropanesulfonate, and stannous sulfosuccinate.

Examples of the soluble salt of gold include potassium chloroaurate, sodium chloroaurate, ammonium chloroaurate, potassium gold sulfite, sodium gold sulfite, ammonium gold sulfite, potassium gold thiosulfate, sodium gold thiosulfate, and ammonium gold thiosulfate.

Examples of the soluble salt of lead include lead acetate, lead nitrate, lead carbonate, lead borofluoride, lead sulfamate, lead methanesulfonate, lead ethanesulfonate, lead 2-hydroxyethanesulfonate, and lead 2-hydroxypropanesulfonate.

A total content of the copper ion-supplying compound and the soluble salt of metal producing an alloy together with copper in the copper alloy electroplating bath of the present invention is not particularly limited. The total content is preferably in the range from about 1 g/L to about 200 g/L, more preferably in the range from about 10 g/L to about 150 g/L.

The combination and the ratio of the copper ion-supplying compound and the soluble salt of metal producing an alloy together with copper are not particularly limited. The combination and the ratio of both the compounds may be suitably adjusted such that the electrodeposits formed from the copper alloy electroplating bath of the present invention have a desired composition.

The copper or copper alloy electroplating bath of the present invention may include, for example, various additives such as an accelerator, a high molecular surfactant, and a leveler in addition to the two or more electrolytes, the one or more copper ion-supplying compounds, and the one or more soluble salts of metal producing an alloy together with copper.

The accelerator is a component that prompts generation of growth nuclei in plating precipitation. Examples of the accelerator include bis(3-sulfopropyl)disulfide (also called 3,3'-dithiobis(1-propanesulfonic acid)), bis(2-sulfopropyl) disulfide, bis(3-sul-2-hydroxypropyl)disulfide, bis(4-sulfopropyl)disulfide, bis(p-sulfophenyl)disulfide, 3-benzothiazolyl-2-thio propanesulfonic acid, N,N-dimethyldithiocarbamyl propanesulfonic acid, N,N-dimethyldithiocarbamic acid-(3-sulfopropyl)-ester, 3-[(aminoiminomethyl)thio]-1-propanesulfonic acid, o-ethyl-diethyl carbonic acid-S-(3-sulfopropyl)ester, mercaptomethanesulfonic acid, mercaptoethanesulfonic acid, mercaptopropanesulfonic acid, and a salt thereof.

As the high molecular surfactant, a nonionic surfactant is particularly preferable. For example, there may be used polyethylene glycol, polypropylene glycol, a Pluronic type surfactant, a Tetronic type surfactant, polyethylene glycol-glyceryl ether, sulfonic acid group-containing polyalkylene oxide addition type amines, and a nonionic polyether type high molecular surfactant.

The leveler (smoothing agent) has a function of suppressing electrodeposition and exhibits effect for smoothing an electrodeposition coating. The leveler is preferably selected from, for example, amines, a dye, imidazolines, imidazoles, benzimidazoles, indoles, pyridines, quinolines, isoquinolines, anilines, and aminocarboxylic acids.

The amines are preferably sulfonic acid group-containing alkylene oxide addition type amines. The sulfonic acid group-containing alkylene oxide addition type amines are classified into the high molecular surfactant because alkylene oxide(s) is(are) added thereto, and may be classified into also the amines and are effective as the leveler.

Specific examples of a nitrogen-containing organic compound other than the amines, which is effective as the leveler, include: a toluidine dye such as Color Index (hereinafter referred to as "C.I.") basic red 2 and toluidine blue; an azo dye such as C.I. direct yellow 1 and C.I. basic black 2; a phenazine dye such as 3-amino-6-dimethylamino-2-methylphenazine monohydrochloride; polyethylenimine; a copolymer of diallylamine and allylguanidine methanesulfonate; EO and/or PO adducts of tetramethylethylenediamine; succinimide; imidazolines such as 2'-bis(2-imidazoline); imidazoles; benzimidazoles; indoles; pyridines such as 2-vinylpyridine, 4-acetylpyridine, 4-mercapto-2-carboxylpyridine, 2,2'-bipyridyl, and phenanthroline; quinolines; isoquinolines; anilines; 3,3',3"-nitrilotripropionic acid; and aminocarboxylic acids such as aminomethyleneaminoacetic acid and diaminomethyleneaminoacetic acid. Among them, there are preferred the toluidine dye such as C.I. basic red 2; the azo dye such as C.I. direct yellow 1; the phenazine dye such as 3-amino-6-dimethylamino-2-methylphenazine monohydrochloride; polyethylenimine; the copolymer of diallylamine and allylguanidine methanesulfonate; the EO and PO adducts of tetramethylethylenediamine; the imidazolines such as 2'-bis(2-imidazoline); the benzimidazoles; the pyridines such as 2-vinylpyridine, 4-acetylpyridine, 2,2'-bipyridyl, and phenanthroline; the quinolines; the anilines; 3,3',3"-nitrilotripropionic acid; and aminocarboxylic acids such as aminomethyleneaminoacetic acid.

A content of each of the various additives in the copper or copper alloy electroplating bath of the present invention is not particularly limited. The content is at least suitably adjusted such that intended electrodeposits are formed from the plating bath.

The copper or copper alloy electroplating bath of the present invention can be initially made by suitably combining: the two or more electrolytes including at least one selected from nitric acid and the nitrate; and optionally, the at least one electrolyte, other than the nitric acids, selected from the acid other than nitric acid, the chloride, the sulfate, the carbonate, the phosphate, the acetate, and the perchlorate; the one or more copper ion-supplying compounds; the one or more soluble salts of metal producing an alloy together with copper; the various additives; and the like.

The copper or copper alloy electroplating bath of the present invention may be used to form desired electrodeposits by electroplating. Examples of the electrodeposits include bump electrodes and electrodeposition coatings. These electrodeposits may be formed on, for example, a wafer, a substrate, or a lead frame.

The copper or copper alloy electroplating bath of the present invention may be used to form a group of high-aspect bump electrodes (copper pillars or copper alloy pillars) having a uniform height at high speed. Each of the copper pillars and the copper alloy pillars is preferably formed to have a height of, for example, 5 μm or more, more preferably in the range from 30 μm to 400 μm.

The copper or copper alloy electroplating bath of the present invention may be used to form an electrodeposition coating having a uniform thickness at high speed, and occurrence of voids can be smoothly prevented when, for example, via holes are filled by plating.

Examples of an electronic component on which the electrodeposits are to be formed include glass substrates, silicon substrates, sapphire substrates, wafers, printed wiring boards, semiconductor integrated circuits, resistors, variable resistors, capacitors, filters, inductors, thermistors, quartz vibrators, switches, lead wires, and solar cells. The copper or copper alloy electroplating bath of the present invention can be used to form the group of high-aspect bump electrodes (copper pillars or copper alloy pillars) having a uniform height at high speed on, for example, a SiP, FOWLP, FOPLP, SoC, or PoP electronic component, in particular, on an electronic component such as a PoP semiconductor component having a three-dimensional structure with a reduced package area.

When electroplating is performed by using the copper or copper alloy electroplating bath of the present invention, for example, there may be adopted various plating methods such as barrel plating, rack plating, high-speed continuous plating, rackless plating, cup plating, and dip plating.

Electroplating conditions are not particularly limited. For example, a bath temperature is preferably 0° C. or higher, more preferably in the range from about 10° C. to about 50° C. A cathode current density is preferably in the range from about 0.001 A/dm$^2$ to about 100 A/dm$^2$, more preferably in the range from about 0.01 A/dm$^2$ to about 40 A/dm$^2$.

After the electroplating, reflow of precipitated copper or copper alloy is performed as necessary to form intended electrodeposits such as bump electrodes or electrodeposition coatings.

EXAMPLES

Sequentially described below are examples of the copper or copper alloy electroplating bath of the present invention, manufacturing examples in which a group of bump electrodes is formed by using the plating bath obtained in each of the examples, and evaluation test examples for occurrence frequency of abnormal precipitation and uniformity in height of the group of bump electrodes obtained by the manufacturing examples.

The present invention is, however, not limited to the examples, the manufacturing examples, or the evaluation test examples, and may be arbitrarily modified within the scope of technical idea of the present invention.

<Example of Copper or Copper Alloy Electroplating Bath>

Among Examples 1 to 21 described below, Examples 1 to 8 and Examples 11 to 21 are examples of the copper electroplating bath, and Examples 9 to 10 are examples of a copper-silver alloy electroplating bath.

Comparative Examples 1 to 3 are blank examples which do not include at least one selected from nitric acid and the nitrate as the electrolyte.

(1) Example 1

A copper electroplating bath having the following composition was initially made. Plating Conditions are also shown.

[Composition]

Copper sulfate pentahydrate (as $Cu^{2+}$): 50 g/L
Sulfuric acid (as free acid): 100 g/L
Nitric acid: 50 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L

[Plating Conditions]

Bath temperature: 30° C.
Cathode current density: 10 A/dm$^2$
Plating time: about 6500 seconds (2) Example 2

A copper electroplating bath having the following composition was initially made. Plating Conditions are also shown.

[Composition]
Copper sulfate pentahydrate (as $Cu^{2+}$): 60 g/L
Sulfuric acid (as free acid): 80 g/L
Nitric acid: 50 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L

[Plating Conditions]
Bath temperature: 30° C.
Cathode current density: 15 A/dm$^2$
Plating time: about 4350 seconds (3) Example 3

A copper electroplating bath having the following composition was initially made. Plating Conditions are also shown.

[Composition]
Copper oxide (as $Cu^{2+}$): 70 g/L
Sulfuric acid: 110 g/L
Nitric acid: 140 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L

[Plating Conditions]
Bath temperature: 30° C.
Cathode current density: 15 A/dm$^2$
Plating time: about 4350 seconds (4) Example 4

A copper electroplating bath having the following composition was initially made. Plating Conditions are also shown.

[Composition]
Copper oxide (as $Cu^{2+}$): 70 g/L
Sulfuric acid: 110 g/L
Nitric acid: 140 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L

[Plating Conditions]
Bath temperature: 35° C.
Cathode current density: 20 A/dm$^2$
Plating time: about 3250 seconds (5) Example 5

A copper electroplating bath having the following composition was initially made. Plating Conditions are also shown.

[Composition]
Copper oxide (as $Cu^{2+}$): 60 g/L
Methanesulfonic acid: 110 g/L
Nitric acid: 120 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L

[Plating Conditions]
Bath temperature: 35° C.
Cathode current density: 15 A/dm$^2$
Plating time: about 4350 seconds (6) Example 6

A copper electroplating bath having the following composition was initially made. Plating Conditions are also shown.

[Composition]
Copper oxide (as $Cu^{2+}$): 70 g/L
Sulfuric acid: 110 g/L
Nitric acid: 140 g/L
Hydrochloric acid (as chloride ions): 50 mg/L
Disodium 3,3'-dithiobis(1-propanesulfonate): 30 mg/L
Polyethylene glycol (average molecular weight: 10000): 150 mg/L

[Plating Conditions]
Bath temperature: 40° C.
Cathode current density: 35 A/dm$^2$
Plating time: about 1850 seconds (7) Example 7

A copper electroplating bath having the following composition was initially made. Plating Conditions are also shown.

[Composition]
Copper nitrate (as $Cu^{2+}$): 60 g/L
Sulfuric acid: 110 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L

[Plating Conditions]
Bath temperature: 35° C.
Cathode current density: 15 A/dm$^2$
Plating time: about 4350 seconds (8) Example 8

A copper electroplating bath having the following composition was initially made. Plating Conditions are also shown.

[Composition]
Copper sulfate pentahydrate (as $Cu^{2+}$): 60 g/L
Sulfuric acid (as free acid): 80 g/L
Nitric acid: 50 g/L
Hydrochloric acid (as chloride ions): 80 mg/L
Disodium 3,3'-dithiobis(1-propanesulfonate): 30 mg/L
2,2'-Bipyridyl: 3 mg/L
Polyethylene glycol (average molecular weight: 10000): 150 mg/L

[Plating Conditions]
Bath temperature: 40° C.
Cathode current density: 40 A/dm$^2$
Plating time: about 1630 seconds (9) Example 9

A copper-silver alloy electroplating bath having the following composition was initially made. Plating Conditions are also shown.

[Composition]
Copper oxide (as $Cu^{2+}$): 70 g/L
Sulfuric acid: 110 g/L
Nitric acid: 140 g/L
Hydrochloric acid (as chloride ions): 50 mg/L
Silver carbonate (as $Ag^{+}$): 0.1 g/L
1-(2-Dimethylaminoethyl)-5-mercaptotetrazole (as complexing agent): 0.2 g/L
Disodium 3,3'-dithiobis(1-propanesulfonate): 30 mg/L
Polyethylene glycol (average molecular weight: 10000): 150 mg/L
[Plating Conditions]
Bath temperature: 30° C.
Cathode current density: 15 A/dm$^2$
Plating time: about 4350 seconds

(10) Example 10

A copper-silver alloy electroplating bath having the following composition was initially made. Plating conditions are also shown.
[Composition]
Copper sulfate pentahydrate (as $Cu^{2+}$): 60 g/L
Sulfuric acid (as free acid): 80 g/L
Nitric acid: 50 g/L
Hydrochloric acid (as chloride ions): 50 mg/L
Silver carbonate (as $Ag^{+}$): 0.1 g/L
1-(2-Dimethylaminoethyl)-5-mercaptotetrazole (as complexing agent): 0.2 g/L
Disodium 3,3'-dithiobis(1-propanesulfonate): 30 mg/L
Polyethylene glycol (average molecular weight: 10000): 150 mg/L
[Plating Conditions]
Bath temperature: 30° C.
Cathode current density: 10 A/dm$^2$
Plating time: about 6500 seconds

(11) Example 11

A copper electroplating bath having the following composition was initially made. Plating conditions are also shown.
[Composition]
Copper sulfate pentahydrate (as $Cu^{2+}$): 50 g/L
Copper carbonate (as $Cu^{2+}$): 10 g/L
Sulfuric acid (as free acid): 100 g/L
Nitric acid: 50 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/dm$^2$
Plating time: about 6500 seconds

(12) Example 12

A copper electroplating bath having the following composition was initially made. Plating conditions are also shown.
[Composition]
Copper sulfate pentahydrate (as $Cu^{2+}$): 50 g/L
Copper acetate monohydrate (as $Cu^{2+}$): 10 g/L
Sulfuric acid (as free acid): 100 g/L
Nitric acid: 50 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/dm$^2$
Plating time: about 6500 seconds

(13) Example 13

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Nitric acid: 50 g/L
Phosphoric acid: 20 g/L
Hydrochloric acid (as chloride ions): 50 mg/L
Disodium 3,3'-dithiobis(1-propanesulfonate): 10 mg/L
Polyethylene glycol (average molecular weight; 1000): 100 mg/L
[Plating Conditions]
Bath temperature: 30° C.
Cathode current density: 10 A/dm$^2$
Plating time: about 6500 seconds

(14) Example 14

A copper electroplating bath having the following composition was initially made. Plating conditions are also shown.
[Composition]
Copper nitrate (as $Cu^{2+}$): 50 g/L
Copper carbonate (as $Cu^{2+}$): 10 g/L
Sulfuric acid: 110 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L
[Plating Conditions]
Bath temperature: 35° C.
Cathode current density: 15 A/dm$^2$
Plating time: about 4350 seconds

(15) Example 15

A copper electroplating bath having the following composition was initially made. Plating conditions are also shown.
[Composition]
Copper nitrate (as $Cu^{2+}$): 60 g/L
Copper acetate monohydrate (as $Cu^{2+}$): 10 g/L
Sulfuric acid: 110 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L
[Plating Conditions]
Bath temperature: 35° C.
Cathode current density: 15 A/dm$^2$
Plating time: about 4350 seconds

(16) Example 16

A copper electroplating bath having the following composition was initially made. Plating conditions are also shown.

[Composition]
Copper nitrate (as $Cu^{2+}$): 60 g/L
Silver nitrate (as $Ag^{+}$); 0.1 g/L
Sulfuric acid (as free acid): 100 g/L
Hydrochloric acid (as chloride ions): 50 mg/L
1-(2-Dimethylaminoethyl)-5-mercaptotetrazole (as complexing agent): 0.2 g/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(17) Example 17

A copper electroplating bath having the following composition was initially made. Plating conditions are also shown.
[Composition]
Copper nitrate (as $Cu^{2+}$): 10 g/L
Nickel nitrate hexahydrate (as $Ni^{2+}$): 20 g/L
Sulfuric acid (as free acid): 100 g/L
Hydrochloric acid (as chloride ions): 50 mg/L
Malonic acid (as complexing agent): 75 g/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(18) Example 18

A copper electroplating bath having the following composition was initially made. Plating conditions are also shown.
[Composition]
Copper nitrate (as $Cu^{2+}$): 60 g/L
Sulfuric acid (as free acid): 100 g/L
Nitric acid: 50 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(19) Example 19

A copper electroplating bath having the following composition was initially made. Plating conditions are also shown.
[Composition]
Copper nitrate (as $Cu^{2+}$): 60 g/L
Sulfuric acid (as free acid): 60 g/L
Nitric acid: 100 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(20) Example 20

A copper electroplating bath having the following composition was initially made. Plating conditions are also shown.
[Composition]
Copper nitrate (as $Cu^{2+}$): 50 g/L
Copper carbonate (as $Cu^{2+}$): 10 g/L
Sulfuric acid (as free acid): 100 g/L
Nitric acid: 50 g/L
Hydrochloric acid (as chloride ions): 50 mg/L
Disodium 3,3'-dithiobis(1-propanesulfonate); 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(21) Example 21

A copper electroplating bath having the following composition was initially made. Plating conditions are also shown.
[Composition]
Copper nitrate (as $Cu^{2+}$): 50 g/L
Copper carbonate (as $Cu^{2+}$): 10 g/L
Sulfuric acid (as free acid): 100 g/L
Nitric acid: 100 g/L
Hydrochloric acid (as chloride ions): 50 mg/L
Disodium 3,3'-dithiobis(1-propanesulfonate): 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(22) Comparative Example 1

A copper electroplating bath having the following composition was initially made. Plating conditions are also shown.
[Composition]
Copper sulfate pentahydrate (as $Cu^{2+}$): 50 g/L
Sulfuric acid (as free acid): 100 g/L
Hydrochloric acid (as chloride ions): 50 mg/L
Disodium 3,3'-dithiobis(1-propanesulfonate); 10 mg/L
Polyethylene glycol (average molecular weight: 1000): 100 mg/L
[Plating Conditions]
Bath temperature: 30° C.
Cathode current density: 10 A/$dm^2$
Plating time: about 6500 seconds

(23) Comparative Example 2

A copper electroplating bath having the following composition was initially made. Plating conditions are also shown.

[Composition]
Copper oxide (as $Cu^{2+}$): 60 g/L
Methanesulfonic acid (as free acid): 110 g/L
Hydrochloric acid (as chloride ions): 50 mg/L
Disodium 3,3'-dithiobis(1-propanesulfonate): 30 mg/L
Polyethylene glycol (average molecular weight: 10000): 200 mg/L
[Plating Conditions]
Bath temperature: 35° C.
Cathode current density: 15 A/dm$^2$
Plating time: about 4350 seconds

(24) Comparative Example 3

A copper-silver alloy electroplating bath having the following composition was initially made. Plating conditions are also shown.
[Composition]
Copper sulfate pentahydrate (as $Cu^{2+}$): 60 g/L
Sulfuric acid (as free acid): 80 g/L
Hydrochloric acid (as chloride ions): 50 mg/L
Silver carbonate (as $Ag^{+}$): 0.1 g/L
1-(2-Dimethylaminoethyl)-5-mercaptotetrazole (as complexing agent): 0.2 g/L
Disodium 3,3'-dithiobis(1-propanesulfonate): 30 mg/L
Polyethylene glycol (average molecular weight: 10000): 150 mg/L
[Plating Conditions]
Bath temperature: 30° C.
Cathode current density: 10 A/dm$^2$
Plating time: about 6500 seconds The copper electroplating baths of Examples 1 to 8 and 11 to 21 and Comparative Examples 1 to 2, and the copper-silver alloy electroplating baths of Examples 9 to 10 and Comparative Example 3 were used to form a large number of bump electrodes (group of bump electrodes), and the occurrence frequency of abnormal precipitation and the uniformity in height of the bump electrodes were evaluated.

Manufacturing Example in which Group of Bump Electrodes is Formed

The copper electroplating baths of Examples 1 to 8 and 11 to 21 and Comparative Examples 1 to 2, and the copper-silver alloy electroplating baths of Examples 9 to 10 and Comparative Example 3 were used to perform electroplating under respective plating conditions, thereby forming a group of bump electrodes (copper pillars or copper-silver alloy pillars, height: about 240 μm, number of pillars: about 5000) on respective silicon substrates.

Evaluation Test Example for Occurrence Frequency of Abnormal Precipitation of Bump Electrodes The formed group of bump electrodes was observed for presence or absence of abnormality (burned coatings, bump electrodes abnormally grown to protrude upward beyond an applied resist, and abnormal growth of bump-like small protrusions on a bump electrode surface), and the number of bump electrodes in which any abnormality was observed was counted. An abnormal precipitation percentage A (%) was calculated according to the following equation (a), and the occurrence frequency of abnormal precipitation was quantitatively evaluated based on the following evaluation criteria.

$$A(\%)=[N(abn)/N(\text{all})]\times 100 \quad \text{(a)}$$

N(abn): Number of bump electrodes in which any abnormality was observed
N(all): Total number of bump electrodes
[Evaluation Criteria]
○: "A" was less than 1%.
Δ: "A" was greater than or equal to 1% and less than 5%.
x: "A" was greater than or equal to 5%.

Evaluation Test Example for Uniformity in Height of Bump Electrodes

The height of each bump electrode in the formed group of bump electrodes was measured. A WID (%) was calculated according to the following equation (b), and the uniformity in height was quantitatively evaluated.

$$WID(\%)=[(\text{Maximum height}-\text{Minimum height})/\text{Average height}]\times\tfrac{1}{2}\times 100 \quad \text{(b)}$$

The following Table 1 shows the results of the evaluation tests for the occurrence frequency of abnormal precipitation and the uniformity in height of the bump electrodes.

TABLE 1

| | Occurrence Frequency of Abnormal Precipitation | Uniformity in Height (%) |
|---|---|---|
| Ex. 1 | ○ | 2.2 |
| Ex. 2 | ○ | 2.4 |
| Ex. 3 | ○ | 4.2 |
| Ex. 4 | ○ | 4.3 |
| Ex. 5 | ○ | 5.5 |
| Ex. 6 | ○ | 5.2 |
| Ex. 7 | ○ | 5.4 |
| Ex. 8 | ○ | 2.7 |
| Ex. 9 | ○ | 4.5 |
| Ex. 10 | ○ | 4.1 |
| Ex. 11 | ○ | 3.1 |
| Ex. 12 | ○ | 3.2 |
| Ex. 13 | ○ | 3.5 |
| Ex. 14 | ○ | 3.4 |
| Ex. 15 | ○ | 3.7 |
| Ex. 16 | ○ | 5.1 |
| Ex. 17 | ○ | 5.5 |
| Ex. 18 | ○ | 2.1 |
| Ex. 19 | ○ | 2.2 |
| Ex. 20 | ○ | 2.8 |
| Ex. 21 | ○ | 2.0 |
| Com. Ex. 1 | ○ | 5.8 |
| Com. Ex. 2 | x | (Unmeasurable) |
| Com. Ex. 3 | Δ | 7.2 |

The followings can be seen from the results shown in Table 1.

Comparative Example 1 is the blank example including no nitric acids which are included in the copper or copper alloy electroplating bath of the present invention. When Comparative Example 1 is compared with Examples 1 to 2, it can be seen that the uniformity in height of the bump electrodes is significantly improved in Examples 1 to 2.

In Manufacturing Example, the copper pillars or the copper-silver alloy pillars having a height of about 240 μm were formed, and a height variation of 1% results in a coating thickness difference of about 5 μm. When reliability at the time of bonding is taken into consideration, the coating thickness difference is desirably as small as possible. When comparison between each of Examples 1 to 2 and Comparative Example 1 is made, difference therebetween is significant.

As in Comparative Example 1, forming the copper pillars having a height of about 240 μm at a cathode current density of 10 A/dm$^2$ requires a plating time of about 6500 seconds.

In contrast, the plating time is reduced to about 1850 seconds in Example 6. That is, use of the copper or copper alloy electroplating bath of the present invention makes high-speed plating possible, and therefore, productivity can be expected to be significantly improved.

In Examples 3 to 4, use of a high-concentration acid and copper ions in combination is realized because nitric acid is included in the bath. In Examples 11 to 13, the use of a high-concentration acid and copper ions in combination is realized because nitric acid and the another electrolyte are included in the bath. In Examples 14 to 15, the use of a high-concentration acid and copper ions in combination is realized because the nitrate and the another electrolyte are included in the bath. In contrast, when the bath includes sulfuric acid which is conventionally generally used without including the nitric acids as in Comparative Example 1, the use of a high-concentration acid and copper ions in combination cannot be realized.

In Examples 18 to 19, the use of a high-concentration acid and copper ions in combination is realized because nitric acid and the nitrate are used in combination. In Examples 20 to 21, the use of a high-concentration acid and copper ions in combination is realized because nitric acid and the nitrate are used in combination and the another electrolyte is also included in the bath. In addition, it can be seen that the uniformity in height of the bump electrodes is significantly improved in these Examples.

Similarly, as in Comparative Example 2, methanesulfonic acid which is conventionally generally used is included in the bath in an attempt to realize the use of a high-concentration acid and copper ions in combination. However, when high-speed plating is performed, abnormal precipitation is observed.

In contrast, when the nitric acids and methanesulfonic acid are used in combination as in Example 5, abnormal precipitation as described above can be prevented even in the case of the high-speed plating performed at the same plating time as in Comparative Example 2.

Note that combining an electrolyte including the nitric acids with a suitable leveler as in Example 8 can achieve higher speed and more improved uniformity.

Comparative Example 3 is the blank example including no nitric acids which are included in the copper or copper alloy electroplating bath of the present invention. When Comparative Example 3 is compared with Examples 9 to 10, there can be seen in Examples 9 to 10 reduced abnormal precipitation of the bump electrodes, improved uniformity in height of the bump electrodes, and effectiveness for the high-speed plating.

INDUSTRIAL APPLICABILITY

The copper or copper alloy electroplating bath of the present invention is effectively applicable to formation of electrodeposits on various electronic components such as SiP, FOWLP, FOPLP, SoC, and PoP electronic components, in particular, on electronic components such as PoP semiconductor components having a three-dimensional structure with a reduced package area.

What is claimed is:

1. A copper or copper alloy electroplating bath comprising two or more electrolytes, wherein the electrolytes include: nitric acid and at least one nitrate salt in combination, wherein the nitrate salt is at least one selected from the group consisting of magnesium nitrate, calcium nitrate, barium nitrate, zinc nitrate, silver nitrate, copper(II) nitrate, nickel nitrate, aluminum nitrate, iron(III) nitrate, and ammonium nitrate, wherein the bath is prepared by a method comprising adding the nitric acid and nitrate salt to the bath in a ratio of the nitric acid to the nitrate salt (nitric acid/nitrate salt (weight ratio)) in a range from 0.5/1 to 10/1, and wherein an addition amount of the nitrate salt in the method is from 128.7 g/L to 177.7 g/L.

2. The copper or copper alloy electroplating bath according to claim 1, wherein the electroplating bath is to be applied to formation of a copper pillar or a copper alloy pillar having a height of 5 μm or more.

3. The copper or copper alloy electroplating bath according to claim 2, wherein the copper pillar or the copper alloy pillar is to be formed on a System in Package (SiP), Fan Out Wafer Level Package (FOWLP), Fan Out Panel Level Package (FOPLP), System on a Chip (SoC), or Package on Package (PoP) electronic component.

4. The copper or copper alloy electroplating bath according to claim 1, wherein the electrolytes further include at least one selected from an acid other than nitric acid, a chloride, a sulfate, a carbonate, a phosphate, an acetate, and a perchlorate.

5. The copper or copper alloy electroplating bath according to claim 4, wherein the acid other than nitric acid is at least one selected from the group consisting of hydrochloric acid, sulfuric acid, methanesulfonic acid, acetic acid, carbonic acid, phosphoric acid, boric acid, oxalic acid, lactic acid, hydrogen sulfide, hydrofluoric acid, formic acid, perchloric acid, chloric acid, chlorous acid, hypochlorous acid, hydrobromic acid, hydriodic acid, nitrous acid, and sulfurous acid.

6. The copper or copper alloy electroplating bath according to claim 4, wherein the chloride is at least one selected from the group consisting of lithium chloride, sodium chloride, potassium chloride, magnesium chloride, calcium chloride, barium chloride, zinc chloride, copper(II) chloride, aluminum chloride, iron(III) chloride, and ammonium chloride.

7. The copper or copper alloy electroplating bath according to claim 4, wherein the carbonate is at least one selected from the group consisting of sodium carbonate, sodium hydrogen carbonate, potassium carbonate, potassium hydrogen carbonate, copper(II) carbonate, and ammonium carbonate.

8. The copper or copper alloy electroplating bath according to claim 4, wherein the phosphate is at least one selected from the group consisting of sodium phosphate, disodium hydrogen phosphate, sodium hydrogen phosphate, potassium phosphate, dipotassium hydrogen phosphate, and potassium hydrogen phosphate.

9. The copper or copper alloy electroplating bath according to claim 4, wherein the acetate is at least one selected from the group consisting of sodium acetate, potassium acetate, calcium acetate, copper(II) acetate, aluminum acetate, and ammonium acetate.

10. The copper or copper alloy electroplating bath according to claim 4, wherein the perchlorate is at least one selected from sodium perchlorate and potassium perchlorate.

11. The copper or copper alloy electroplating bath according to claim 1, wherein an amount of copper ion (Cu(II) ion) in the bath is from 10 g/L to 70 g/L.

12. The copper or copper alloy electroplating bath according to claim 1, wherein the addition amount of the nitrate salt in the method is from 147.9 g/L to 177.5 g/L.

13. The copper or copper alloy electroplating bath according to claim 1, wherein an amount of a metal ion in the bath, the metal ion being derived from the nitrate salt, is from 0.1 g/L to 60 g/L.

* * * * *